US008881457B2

(12) United States Patent
Matsushita

(10) Patent No.: US 8,881,457 B2
(45) Date of Patent: Nov. 11, 2014

(54) WINDOW REGULATOR

(75) Inventor: Masayuki Matsushita, Takarazuka (JP)

(73) Assignee: Hi-Lex Corporation, Hyogo (JP)

( * ) Notice: Subject to any disclaimer, the term of this patent is extended or adjusted under 35 U.S.C. 154(b) by 0 days.

(21) Appl. No.: 13/819,162

(22) PCT Filed: Aug. 27, 2011

(86) PCT No.: PCT/JP2011/069359

§ 371 (c)(1),
(2), (4) Date: May 13, 2013

(87) PCT Pub. No.: WO2012/026605

PCT Pub. Date: Mar. 1, 2012

(65) Prior Publication Data

US 2013/0227889 A1 Sep. 5, 2013

(30) Foreign Application Priority Data

Aug. 27, 2010 (JP) ..... 2010-190575

(51) Int. Cl.
*E05F 11/48* (2006.01)

(52) U.S. Cl.
USPC ..... 49/352

(58) Field of Classification Search
USPC ..... 49/352, 348, 349, 372, 374, 212, 213
See application file for complete search history.

(56) References Cited

U.S. PATENT DOCUMENTS

| | | | | | |
|---|---|---|---|---|---|
| 4,759,653 | A * | 7/1988 | Maekawa et al. | ..... | 403/24 |
| 5,309,678 | A * | 5/1994 | Adachi | ..... | 49/352 |
| 5,505,022 | A * | 4/1996 | Shibata et al. | ..... | 49/352 |
| 5,528,861 | A * | 6/1996 | Beyerlein | ..... | 49/352 |
| 5,740,630 | A * | 4/1998 | Medebach | ..... | 49/352 |
| 5,749,174 | A * | 5/1998 | Mariel | ..... | 49/352 |
| 5,832,667 | A * | 11/1998 | Buening et al. | ..... | 49/212 |
| 8,096,080 | B2 * | 1/2012 | Pavlovic et al. | ..... | 49/348 |
| 8,215,060 | B2 * | 7/2012 | Sasaki et al. | ..... | 49/322 |
| 2008/0236049 | A1 * | 10/2008 | Arimoto | ..... | 49/352 |
| 2009/0007495 | A1 * | 1/2009 | Smith | ..... | 49/352 |

FOREIGN PATENT DOCUMENTS

| | | | | |
|---|---|---|---|---|
| JP | 02272186 A | * | 11/1990 | ..... E05F 11/48 |
| JP | H06-13360 Y2 | | 4/1994 | |
| JP | H09-150631 A | | 6/1997 | |
| JP | 2006-009475 A | | 1/2006 | |

OTHER PUBLICATIONS

International Search Report of corresponding International Application No. PCT/JP2011/069359, dated on Oct. 18, 2011.

* cited by examiner

*Primary Examiner* — Jerry Redman

(74) *Attorney, Agent, or Firm* — Global IP Counselors, LLP

(57) ABSTRACT

A window regulator has a small number of parts and a simple structure and avoids the generation of noise. An upper wire-end having a flange portion is connected to the end portion of a raising wire connected to a carrier plate. A wire-end storage portion having a hollow portion surrounded by a top wall and a circumferential wall extending downward from a rim of the top wall is formed on the carrier plate. A plurality of ribs are formed on the wire-end storage portion along an axis direction of the wire-end storage portion, while protruding from the circumferential wall to the hollow portion. The flange portion is in contact with at least two of the ribs.

8 Claims, 5 Drawing Sheets

WINDOW REGULATOR

CROSS-REFERENCE TO RELATED APPLICATIONS

This U.S. National stage application claims priority under 35 U.S.C. §119(a) to Japanese Patent Application No. 2010-190575, filed in Japan on Aug. 27, 2010, the entire contents of Japanese Patent Application No. 2010-190575 are hereby incorporated herein by reference.

BACKGROUND

1. Field of the Invention

The present invention relates to a window regulator configured to raise and lower a window glass. Particularly, the present invention relates to a window regulator used in a car.

2. Background Information

A window regulator raises and lowers a window glass fixed to a carrier plate by rolling and feeding around and from a drum wires connected to the carrier plate. There is a case where an operation noise of the window regulator is noticed as an abnormal noise. Especially in an electric car, since an inner space is quiet compared to that of a car using a fossil fuel such as gasoline, even a small noise is noticed as an abnormal noise. It is known that one of main origins of such an abnormal noise is the movement of a wire-end of a wire in a wire-end storage portion of the carrier plate.

A slider base (a carrier plate) of a window regulator shown in Japanese Laid-Open Patent Application H09-150631 is guided along a guide rail, while holding a window glass. An end support is arranged on the slider base and a wire-end of a wire is engaged with the end support via a slide bush. An end portion of the wire-end that is close to a wire exit is engaged with wall portions of the end support arranged in the direction of the guide rail. Thus, the generation of a noise, caused by the end portion of the wire-end that is close to the wire exit being in contact with the end surface of the end support in the direction of the guide rail, can be avoided.

A box-shaped wire-end storage portion is arranged on a carrier plate of a window regulator shown in Japanese Laid-Open Patent Application 2006-9475. A bush is arranged inside the wire-end storage portion. A hollow portion, extending in the same direction of the extension of a wire, is formed in the bush. The hollow portion includes a small diameter portion and a large diameter portion that is continued from the small diameter portion via a step portion. In the small diameter portion, a helical spring for absorbing the slack of a wire, having the same diameter as the small diameter portion, is arranged. Thus, the helical spring can be supported in a proper position and can be deflected straight and smoothly in an axis direction. In addition, a wire-end having the same diameter as the large diameter portion is arranged in the large diameter portion. Thus, the wire-end can move smoothly in the axis direction of the bush. Moreover, since the moving direction of the wire-end and the biasing direction of the helical spring are the same, the wire-end can move smoothly and the helical spring can be deflected smoothly. Thus, the generation of a noise in operating the window regulator can be avoided.

SUMMARY

Since the techniques disclosed in Japanese Laid-Open Patent Application H09-150631 and Japanese Laid-Open Patent Application 2006-9475 need discrete parts for each of upper and lower wire-ends, the number of parts increases. In addition, as the number of parts increases, time and effort increases for assembling the parts and checking if they are assembled properly.

The inventor found that a noise is generated when the carrier plate is about to be raised after the carrier plate is restricted at the bottom dead point, because the wire-end connected to the end portion of the raising wire is in contact with the inner surface of the circumferential wall of the wire-end storage portion.

Then, the object of the present invention is to provide a window regulator that has a smaller number of parts and a simpler structure and can avoid effectively the generation of a noise.

A window regulator according to the present invention comprises a carrier plate connected to a window glass of a vehicle, a drum configured to be rotary-driven, a raising wire including one end connected to the carrier plate and another end connected to the drum via a direction-changing member fixed to an upper section of a door of the vehicle, and a lowering wire including one end connected to the carrier plate and another end connected to the drum. Thus, the window glass of the window regulator is raised and lowered by rolling one of the two wires around the drum and feeding another wire. The window regulator includes a wire-end, a wire-end storage portion, and a plurality of ribs. The wire-end has a flange portion connected to an end portion of the raising wire that is connected to the carrier plate. The wire-end storage portion is formed on the carrier plate. The wire-end storage portion has a hollow portion surrounded by a top wall and a circumferential wall extending downward from a rim of the top wall. The plurality of ribs are formed on the wire-end storage portion along an axis direction of the wire-end storage portion. The plurality of ribs protrude from the circumferential wall to the hollow portion. The flange portion is in contact with at least two of the ribs.

ADVANTAGEOUS EFFECTS (1) In the window regulator according to the present invention, the flange portion of the wire-end of the raising wire is arranged such that the flange portion is in contact with at least two of the plurality of ribs arranged in the end storage portion. Thus, the noise can be reduced which is generated when the flange portion of the wire-end of the raising wire are being in contact with the end storage portion of the carrier plate. In addition, since discrete parts are not needed, the structure is simple.

(2) In such a window regulator, it is acceptable that the ribs are formed linearly and parallel to the axis direction of the wire-end storage portion so that the direction in which the ribs are arranged and the direction of the movement of the wire-end are the same. In this case, the flange portion of the wire-end is reliably supported and the flange portion of the wire-end smoothly slides relative to the ribs.

(3) In addition, it is acceptable that the window regulator includes a driving unit having a drum, and a guide rail connecting the direction-changing member and the driving unit and curved in accordance with the shape of the door. In this case, since the vibration due to the contact is absorbed also by the guide rail via the carrier plate, the generated noise can be reduced.

(4) Moreover, it is acceptable that the cross-section of the guide rail is U-shaped. In this case, the width of the guide rail is reduced, so that the sliding part of the carrier plate with the guide rail can be reduced. Thus, the flexibility of the arrangement of the wire-end storage portion increases. Therefore, the wire-end storage portion can be arranged at the position where the probability of the generation of a noise is small, for example, at the position where the angle between the raising wire and the direction-changing member at the upper side does not become large.

DETAILED DESCRIPTION OF EMBODIMENTS

Figure 1:
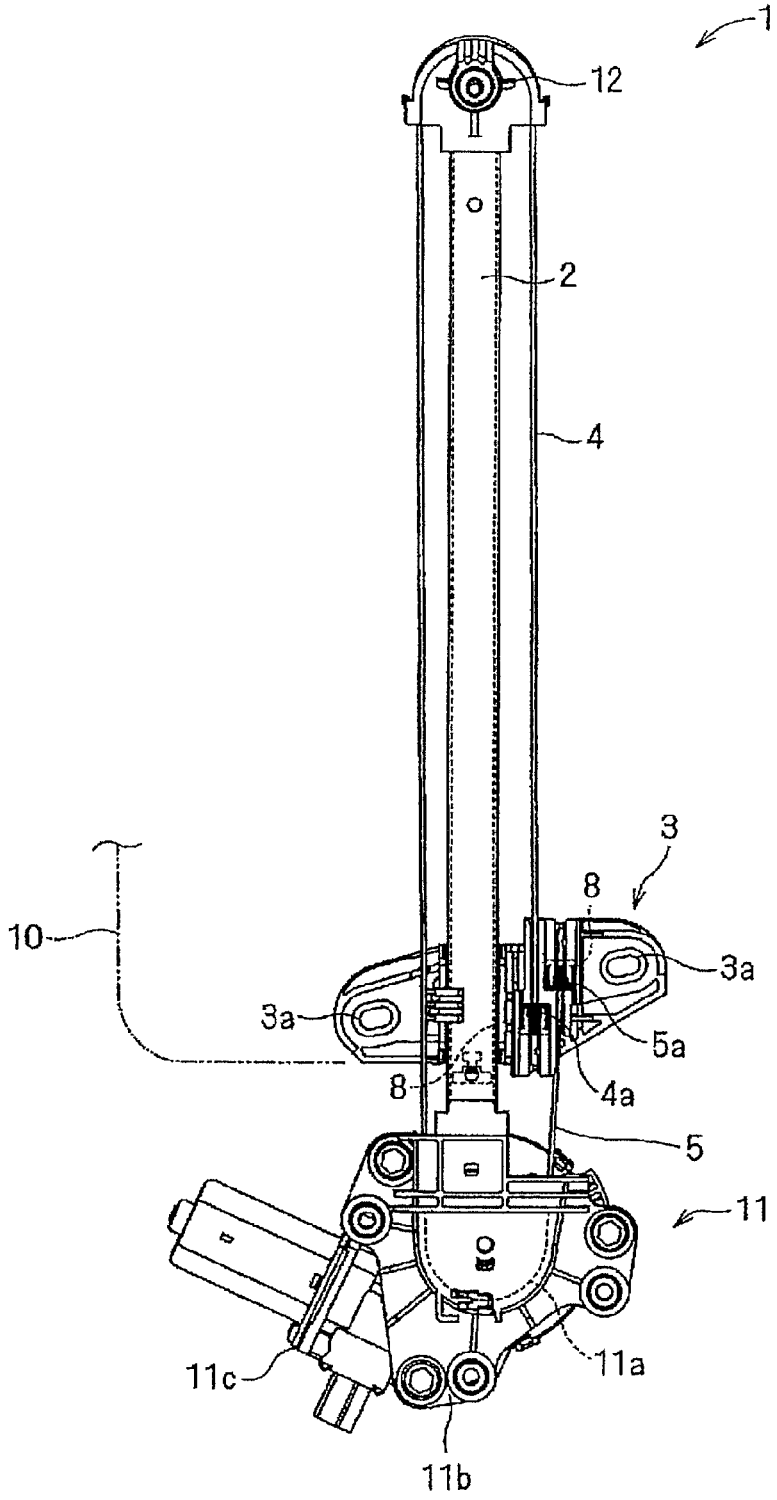
FIG. 1 is a front view of one embodiment of a window regulator according to the present invention.

A window regulator 1 shown in FIG. 1 comprises a guide rail 2, a carrier plate 3 that is slidably engaged with the guide rail 2 and is connected to a window glass 10 of a vehicle, and a driving unit 11 arranged at the bottom end of the guide rail 2. In the driving unit 11, a drum 11*a* configured to be rotary-driven is arranged. A direction-changing member 12 is arranged at the upper end of the guide rail 2. One end of a raising wire 4 extends upward along the guide rail 2 and one end of a lowering wire 5 extending downward along the guide rail 2 are connected to the carrier plate 3. The extending direction of the raising wire 4 is changed to downward by the direction-changing member 12. Then, another end of the raising wire 4 is connected to the drum 11*a* of the driving unit 11. In addition, the lowering wire 5 extends downward and another end of the lowering wire 5 is engaged with the drum 11*a*. It should be noted that, in the window regulator 1 shown in FIG. 1, the carrier plate 3 is at the bottom end of the movement (bottom dead point) but not in a restricted state. The restricted state is a state in which the carrier plate 3 is at the bottom dead point and made unmovable by rolling the drum 11*a* further to a rolling direction for the lowering wire 5 to generate a large tension to the lowering wire 5. It should be noted that FIG. 1 shows the window regulator 1 installed to a right rear door of a vehicle body and viewed from inside of the vehicle body.

The window regulator according to the present invention may be a delta type or a twin-lift type other than a bottom-end-drive type as shown in FIG. 1 in which the driving unit 11 is arranged at the bottom end of the guide rail 2. The delta type window regulator is a window regulator in which another direction-changing member is also arranged at the bottom end of the guide rail, the wires are routed to the upper and lower direction-changing members so that the wires become loop shape, and the driving unit 11 is arranged at the place other than the guide rail. The twin-lift type window regulator is a window regulator in which the direction-changing members, each arranged at the upper left side, the upper right side, the lower left side, and the lower right side of an inner panel of the vehicle body, are arranged and the wires are routed to the direction-changing members so that the wires become "8" shape. Other known window regulators may be used.

The guide rail 2 is a long metal member that extends upward and downward so as to connect the direction-changing member 12 with the driving unit 11. In addition, the guide rail 2 is bent in accordance with a shape of the door (See FIG. 4). The guide rail 2 is U-shaped in cross section (See a two-dot chain line of FIG. 2). Therefore, it is easy to manufacture the guide rail 2 and the width of the guide rail 2 can be small. Thus, the sliding part of the carrier plate with the guide rail can be small. As a result, the flexibility of the arrangement of the wire-end storage portion increases. Therefore, the carrier plate 3 described later can be arranged at the position where the probability of the generation of a noise is small, for example, at the position where the angle between the raising wire and the direction-changing member at the upper side does not become large.

A wire guide or a pulley that is slidably in contact with the wire can be used as the direction-changing member 12. When the window regulator is a delta type or a twin-lift type, it is preferable that the direction-changing member at the upper end is a pulley and the direction-changing member at the bottom end is a wire guide. It should be noted that the lower direction-changing member may be a pulley and the upper direction-changing member may be a wire guide. The pulley and the wire guide are conventionally known.

The raising wire 4 and the lowering wire 5 are conventionally known ones made of a plurality of twisted metal wires. It should be noted that in a delta type window regulator, for example, the wires may be guided using a guiding pipe arranged between the direction-changing member 12 and the driving unit 11. A known pipe with some flexibility can be used as the guiding pipe. The known pipe with some flexibility is formed by winding helically a metal wire having a rectangular cross section to form a pipe and by coating the outer surface of the pipe with synthesized resin.

A columnar wire-end having a seating surface 4*c* that is planar and perpendicular to the axis direction of the wire is connected to the end portion of each of the raising wire 4 and the lowering wire 5 (See FIG. 5). A flange portion 4*b* is arranged at the tip of the wire-end 4*a* of the raising wire (hereinafter, an upper wire-end). The flange portion 4*b* is a portion on which the end portion of the biasing member 8 is supported. In the present embodiment, the flange portion is also arranged at the tip of the wire-end 5*a* of the lowering wire (hereinafter, an lower wire-end) and the biasing member 8 is supported on the flange portion. These wire-ends can be obtained by using a die-cast method formed by casting a metal such as zinc or a zinc alloy to a mold.

Figure 2A:
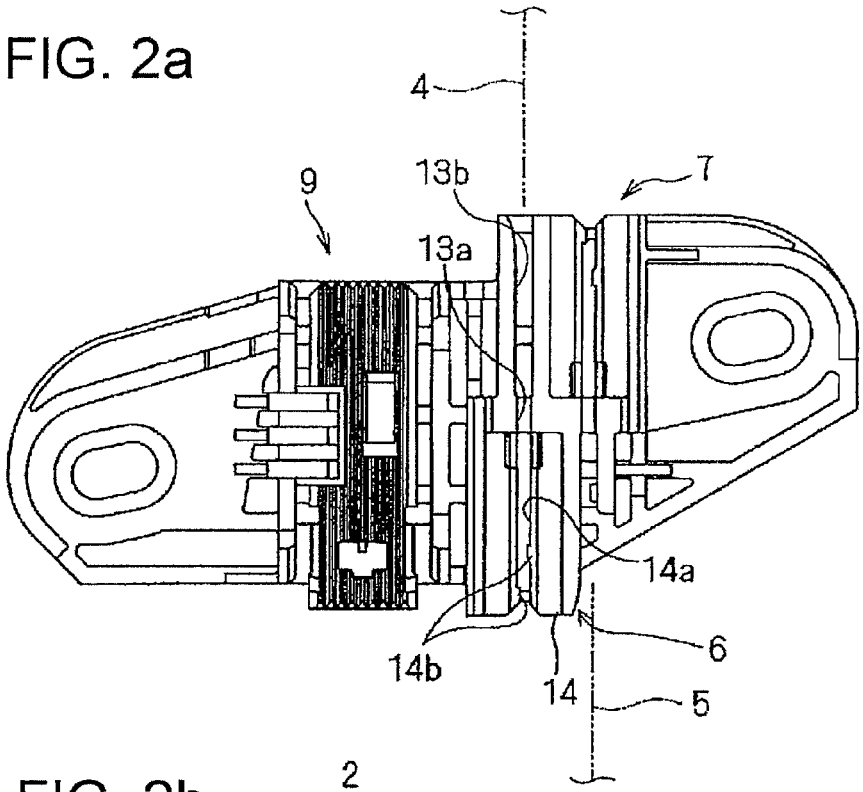
FIG. 2*a* is a front view of a carrier plate.
Figure 2B:
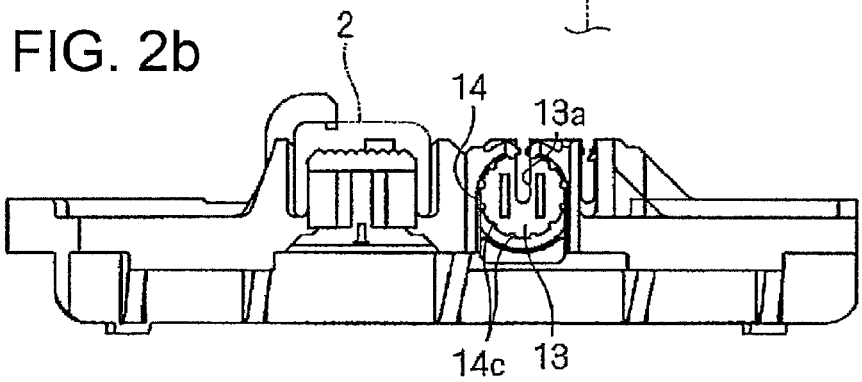
FIG. 2*b* is a bottom view of the carrier plate shown in FIG. 2*a*.
Figure 2C:
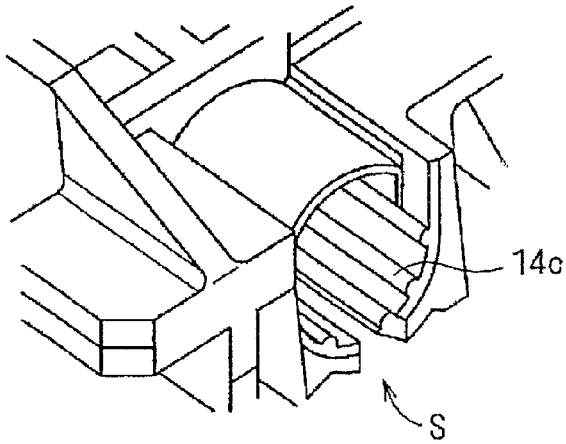
FIG. 2*c* is a partial enlarged perspective view of the carrier plate shown in FIG. 2*a;*

As shown in FIG. 2*a*, wire-end storage portions 6 and 7 are arranged at the center of the carrier plate 3. The wire-end storage portions 6 and 7 accommodates the wire-ends 4*a* and 4*b* (See FIG. 1), respectively, of the raising wire 4 and the lowering wire 5. In addition, a biasing member 8 (See FIG. 1) for removing the slack of the wire is accommodated in the wire-end storage portions 6, 7. Moreover, in the vicinity (left side in the Figure) of the wire-end storage portions 6, 7, a guide portion 9 slidably holding the guide rail 2 is arranged. In addition, mounting holes 3*a*, 3*a* are formed at the both sides of the wire-end storage portions 6, 7 in the carrier plate 3. The mounting holes 3*a*, 3*a* are used for fixing the carrier plate 3 to the window glass 10 (refer to FIG. 1). It should be noted that it is preferable that the carrier plate 3 is formed of synthesized resin as one piece. Materials with high resistivity to abrasion such as polybutyleneterephthalate (PBT) or polyoxymethylene (POM) are preferable for the synthesized resin.

The wire-end storage portion 6 of the raising wire (hereinafter, an upper end storage portion) is approximately cylindrical so that the upper wire-end 4*a* and the biasing member 8 can be accommodated inside. The wire-end accommodation portion 6 includes a planar top wall 13 (See FIG. 2*b*) and a circumferential wall 14 extending downward from the rim of the top wall 13. It should be noted that a reference S indicates a hollow portion (See FIG. 2*c*) that is a space surrounded by the top wall 13 and the circumferential wall 14.

A short slit 13*a* is formed in the top wall 13. The short slit 13*a* is open from the vicinity of the center of the top wall 13 to outside (See FIG. 2*b*). Through the short slit 13*a*, the raising wire 4 is passed to the upper end storage portion 6. It should be noted that the cross section of hollow portion S surrounded by the circumferential wall 14 is preferably round, but it can also be polygonal.

Figure 3A:
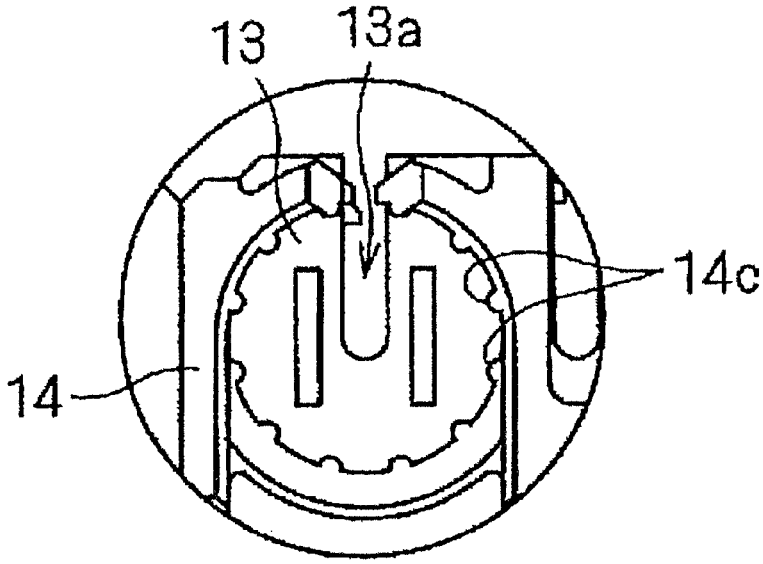
FIG. 3*a* is a partial enlarged view of FIG. 2*b* and FIG. 3*b* is a schematic view that shows the wire-end arranged in a hollow portion shown in FIG. 3*a;*
Figure 3B:
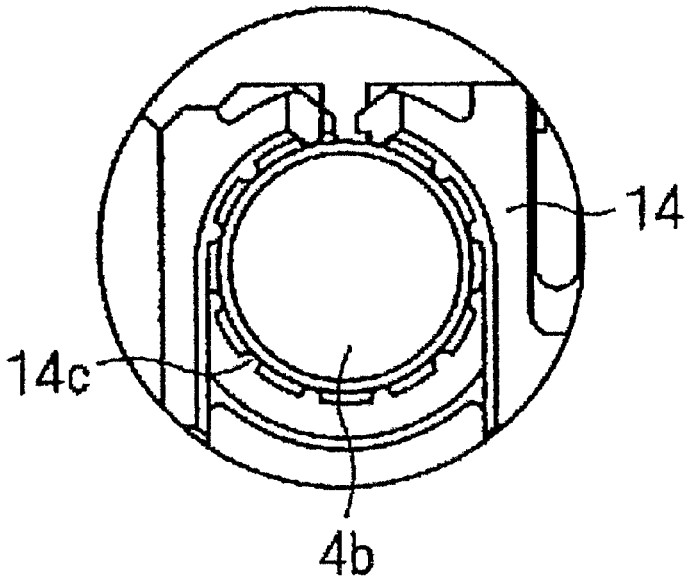

As shown in FIG. 3*b* and FIG. 3*c*, a plurality of ribs 14*c* protruding toward the central axis of the hollow portion S are formed on the circumferential wall 14. The ribs 14*c* extend in parallel along the axis direction of the upper end storage portion 6 and across the whole length of the circumferential wall 14 to reach the top wall 13. In addition, these ribs 14*c* are arranged at approximately equal intervals. Moreover, the cross section of the rib 14*c* is a shrinking shape where the width of the rib 14*c* becomes smaller toward the tip and the tip is formed in circular convex arc. The cross section of the rib 14*c* may be triangular, quadrangular, or trapezoidal. It should be noted that the ribs 14*c* may not be arranged at equal intervals. If the ribs 14*c* are not arranged at equal intervals, the ribs 14*c* facing each other may be arranged in axially symmetric to the central axis of the hollow portion S. In addition, the ribs 14*c* may helically extend in axis direction of the upper end storage portion 6. Moreover, the ribs 14*c* may be curved in the middle. In addition, the inner diameter of the circumferential wall 14 (in the cross section of the circumferential wall, the diameter of the approximate circle that connects the tips of the plurality of ribs 14*c*) is the same as or slightly larger than the outer diameter of the flange portion 4*b*. Thus, the flange portion 4*b* can move smoothly inside the circumferential wall 14. It should be noted that the contact area for sliding is decreased compared with the case where the whole of the inner surface of the circumferential wall 14 is a sliding surface because the sliding surfaces are the tip of the plurality of ribs 14*c* and the outer surface of the flange portion 4*b* of the upper wire-end 4. Since the ribs 14*c* are arranged on the inner surface of the circumferential wall 14 such that they extend in the axis direction, however, the flange portion 4*b* is reliably supported by the ribs 14*c* so that the sliding is smooth.

Back to FIG. 2*a*, at the upper side of the top wall 13, a routing path 13*b* extends in the extending direction of the raising wire 4. The routing path 13*b* is continued from the upper end of the short slit 13*a* and has approximately the same cross section as that of the short slit 13*a*. Thus, the routing path 13*b* guides the raising wire 4 to the upper end storage portion 6 via the short slit 13*a*.

Since the wire-end storage portion 7 of the lowering wire 5 (hereinafter, a lower end storage portion) has approximately the same shape as that of the upper end storage portion 6 and only the direction of the arrangement is different from the upper end storage portion 6, the numbers of the upper end storage portion 6 are assigned to the same ones of the lower end storage portion 7 and the explanations of the same parts will be omitted. The lower end storage portion 7 is arranged such that the upper end storage portion 6 is turned upside down and adjacent to the upper end storage portion 6 while both of the top walls 13 are adjacent to each other. The circumferential wall 14 of one end storage portion and the routing path 13*b* of another end storage portion are formed integrally and adjacent to each other. For this, some of the members are used in common. It should be noted that the ribs 14*c* does not have to be arranged in the lower end storage portion 7 if a small noise is generated between the wire-end 5*a* of the lowering wire (hereinafter, a lower wire-end) and the lower end storage portion 7, or little noise is generated between them.

The biasing member 8 is a helical compression spring and the cylindrical part of the upper wire-end 4*a* is inserted inside the helix. Then, one end is supported on the flange portion 4*b* and another end is supported on the top wall 13. It should be noted that the biasing member 8 may have other shapes.

Back to FIG. 1, the driving unit 11 includes housings 11*b*, a motor assembly 11*c* (including a motor, a decelerator, and etc.) fixed to the housings 11*b* with fastener elements such as bolts (not shown), and a drum 11*a* engaged with an output shaft of the motor assembly 11*c* for being rotary-driven and sandwiched within the housing 11*b*. It should be noted that a bracket may be fixed in the vicinity of the middle of the guide rail 2 and the driving unit 11 may be fixed to the bracket if the window regulator is a delta type. In addition, it may be fixed directly to the inner panel of the vehicle body.

Figure 4A:
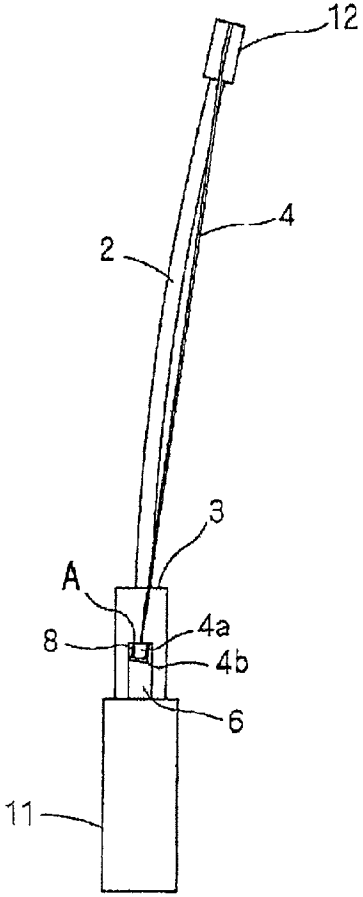
FIGS. 4*a* to 4*d* are views that explain a carrier plate moving to the bottom dead point, in a restricted state, and then about to be raised.
Figure 4B:
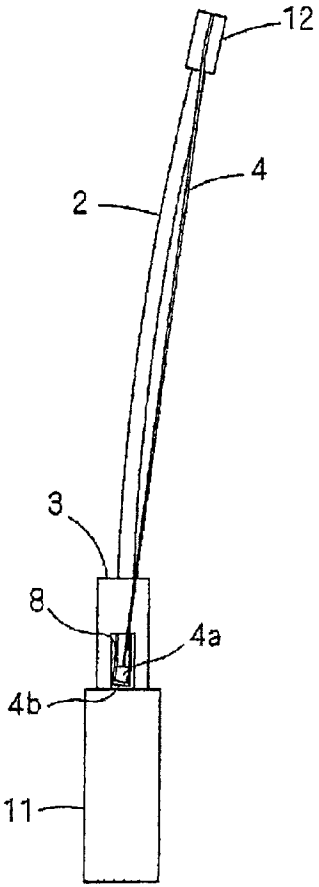
Figure 4C:
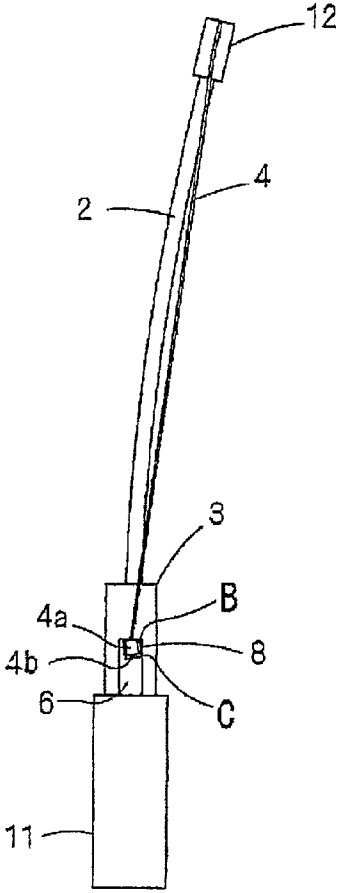

Next, the case where the carrier plate 3 is moved to the bottom dead point, restricted by a stopper at the bottom dead point, and then raised will be explained. FIG. 4*a* shows the upper wire-end 4*a* inside the upper end storage portion 6 when the carrier plate 3 is moved to the bottom dead point by driving the driving unit 11 (See FIG. 1). When the carrier plate 3 reaches the bottom dead point, the carrier plate 3 cannot move downward any further due to the contact between the carrier plate 3 and the stopper (not shown) arranged in the guide rail 2. In this case, the raising wire 4 is inclined obliquely toward the direction-changing member 12 relative to the axis direction of the upper end storage portion 6 because the guide rail 2 is convex outwardly from the vehicle (See FIG. 5*a*). Then, when the lowering wire 5 is further rolled around the drum 11*a*, by driving the driving unit 11, the raising wire 4 is slacked because the raising wire 4 is fed from the drum 11*a* in spite that the carrier plate 3 does not move. Here, as shown in FIG. 4*b*, due to biasing force of the biasing member 8, the upper wire-end 4*a* is also biased such that the upper wire-end 4*a* departs from the top wall 13 in the state where the upper wire-end 4*a* is also inclined obliquely relative to the upper end storage portion 6. Thus, the slack of the raising wire 4 is absorbed (restriction state, see FIG. 5*b*).

Figure 5A:
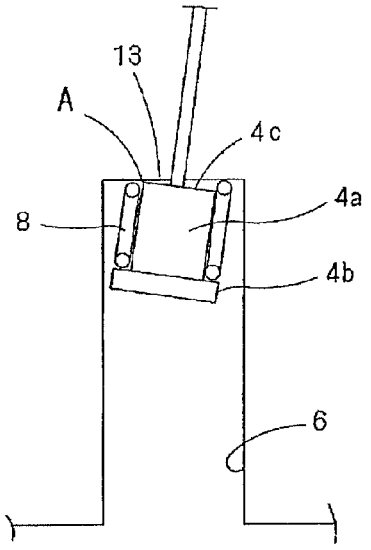
FIGS. 5*a* to 5*d* are partial enlarged views of FIGS. 4*a* to 4*d* that show a wire-end accommodated in a wire-end storage portion.
Figure 5B:
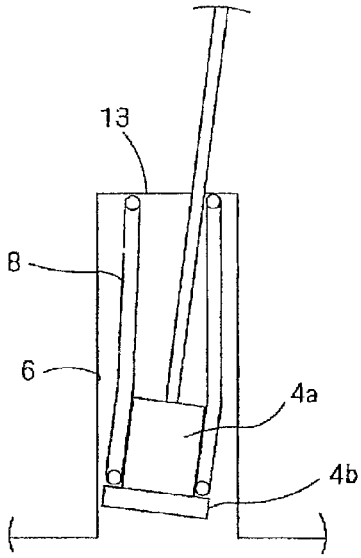

If the upper wire-end 4*a* could slide smoothly inside the upper end storage portion 6 in raising the carrier plate 3, the upper wire-end 4*a* would approach the top wall 13 against biasing force of the biasing member 8 and the contact point A of the seating surface 4*c* would first get into contact with the top wall 13 as shown in FIG. 5*a*. Then, the contact point B (See FIG. 5*c*) would be in contact with the top wall 13.

Figure 4D:
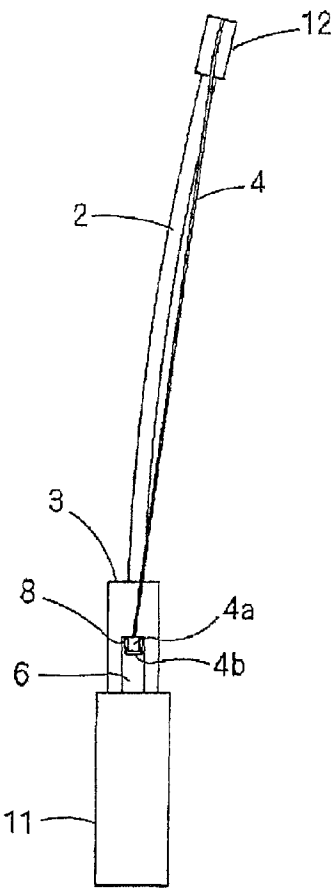
Figure 5C:
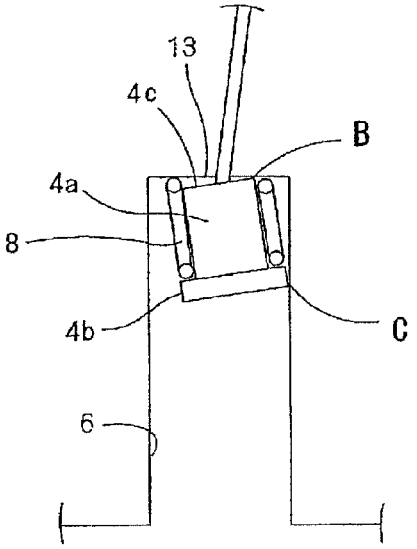
Figure 5D:
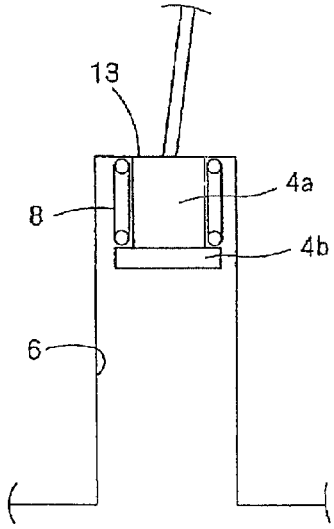

However, in reality, due to the momentum generated in the transmission from the state shown in FIG. 4*b* to the state shown in FIG. 4*a*, the touching point A of the seating surface 4*c* gets away from the top wall 13 after the state shown in FIG. 4*d* and the contact point C of the flange portion 4*b* of the upper wire-end 4*a* is strongly in contact with the inner surface of the circumferential wall 14 (See FIG. 5*c*). Then, the upper wire-end 4*a* becomes parallel to the upper end storage portion 6 from the state where the upper wire-end 4*a* is inclined obliquely relative to the upper end storage portion 6, because the seating surface of the upper wire-end 4*a* and the top wall 13 of the upper end storage portion 6 are planar (See FIG. 5*d*).

Here, since the ribs 14*c* are formed on the inner surface of the circumferential wall 14, the contact area of the outer surface of the flange portion 4*b* with the inner surface of the circumferential wall 14 is kept small. Therefore, the generation of a noise can be reduced because a large vibration is not generated even if they are strongly in contact with each other. In addition, since the outer surface of the flange portion 4*b* are in contact with at least two of the ribs 14*c*, the vibration is dispersed and the generation of a noise can further be reduced. In addition, since the vibration due to the contact is absorbed also with the guide rail 2 via the carrier plate 3, a generated noise can be small. Moreover, since discrete parts are not needed, the structure is simple. It should be noted that, if the ribs 14*c* are formed linearly and parallel to the axis direction of the upper end storage portion 6, rain water running through the raising wire 4 and then reaching the upper end storage portion 6 can also be exhausted smoothly between the ribs 14*c* to outside.

The upper wire-end 4*a* is easy to be inclined in the upper end storage portion 6 because the upper wire-end 4*a* has the flange portion 4*b*. Namely, the generation of a noise is effectively avoided even though the upper wire-end 4*a* does not have the long enough surface for sliding against the inner surface of the upper end storage portion 6 to restrict the inclination (the sliding surface is short because the flange portion 4*b* is thin). Thus, the present invention is an effective noise-avoiding technique for other wire-ends with short sliding surfaces, namely for example, eroding conical wire-ends, inverted conical wire-ends, etc. with large backlash in the inner surface of the upper end storage portion.

The window regulator 1 can also be used for doors of other positions of the vehicle body. Further, it may be used for window glass of ships, airplanes, trains, and etc.

The invention claimed is:

1. A window regulator for raising and lowering a window glass of a vehicle, comprising:

a carrier plate connected to the window glass;

a drum configured to be rotary-driven;

a direction-changing member fixed to an upper section of a door of the vehicle;

a raising wire including a first end connected to the carrier plate and a second end connected to the drum via the direction-changing member;

a lowering wire including a first end connected to the carrier plate and a second end connected to the drum;

an upper wire-end connected to the first end of the raising wire, the upper wire-end having a first flange portion;

an upper wire-end storage portion formed on the carrier plate, the upper wire-end storage portion having a first hollow portion surrounded by a first top wall and a first circumferential wall extending downward from a rim of the first top wall, the first hollow portion storing the upper wire-end therein; and a plurality of first ribs formed on the first circumferential wall along an axis direction of the upper wire-end storage portion, the first ribs protruding from the first circumferential wall to the first hollow portion, at least two of the first ribs being in contact with the first flange portion.

2. The window regulator according to claim 1, wherein the first ribs are formed linearly and parallel to the axis direction of the upper wire-end storage portion.

3. The window regulator according to claim 1, further comprising:

a driving unit having the drum; and a guide rail connecting the direction-changing member and the driving unit and being curved in accordance with a shape of the door.

4. The window regulator according to claim 3, wherein a cross section of the guide rail is U-shaped.

5. The window regulator according to claim 1, further comprising:

a lower wire-end connected to the first end of the lowering wire, the lower wire-end having a second flange portion; and a lower wire-end storage portion formed on the carrier plate, the lower wide-end storage portion having a second hollow portion surrounded by a second top wall and a second circumferential wall extending upward from a rim of the second top wall, the second hollow portion storing the lower wire-end therein.

6. The window regulator according to claim 5, wherein the upper wire-end storage portion and the lower wire-end storage portion are formed integrally with each other.

7. The window regulator according to claim 5, wherein a plurality of second ribs are formed on the second circumferential wall of the lower wire-end storage portion.

8. The window regulator according to claim 7, wherein the second ribs are formed linearly and parallel to the axis direction of the lower wire-end storage portion.

* * * * *